United States Patent [19]

Sherwood

[11] Patent Number: 4,904,215

[45] Date of Patent: Feb. 27, 1990

[54] SURFBOARD FIN RETAINER

[75] Inventor: Kent Sherwood, Santa Monica, Calif.

[73] Assignee: Fiberfoam Inc., Los Angeles, Calif.

[21] Appl. No.: 308,657

[22] Filed: Feb. 9, 1989

[51] Int. Cl.[4] ..... A63C 9/32

[52] U.S. Cl. ..... 441/79; 114/140; 156/267

[58] Field of Search ..... 441/74, 79; 114/140, 114/357; 156/267, 293

[56] References Cited

U.S. PATENT DOCUMENTS

| | | | |
|---|---|---|---|
| 3,965,514 | 6/1976 | Shafer et al. | 441/79 |
| 4,379,703 | 4/1983 | Mizell | 441/79 |
| 4,804,347 | 2/1989 | Ross | 441/79 |

*Primary Examiner*—Joseph F. Peters, Jr.
*Assistant Examiner*—Jesûs Sotelo
*Attorney, Agent, or Firm*—Freilich Hornbacker Rosen & Fernandez

[57] ABSTRACT

A retainer is described for holding the fin box of a surfboard, windsurfer, or small sailboat very securely to the rest of the board to greatly resist breakout of the fin box from the board, which is of relatively low cost and of light weight. The retainer is formed primarily of foam of a density greater than the foam in the rest of the board, and is molded to the fin fox to bond thereto. The retainer extends up from the fin box so the assembly formed by the retainer and fin box has a height equal to the thickness of the unfinished board. A groove is cut in the unfinished board through the entire thickness of the board, and the retainer/fin box assembly is placed in the groove with the upper and lower surfaces of the assembly even with the upper and lower surfaces of the unfinished board. When the unfinished board is "glassed" to finish it (a strong thin surface layer is bonded to the surface), the bonding resin in the surface layer also bonds to the upper and lower surfaces of the retainer/-fin box assembly to securely hold the fin box, thereby transferring loads from surface to surface. The retainer can include a plastic sleeve around the retainer foam.

14 Claims, 2 Drawing Sheets

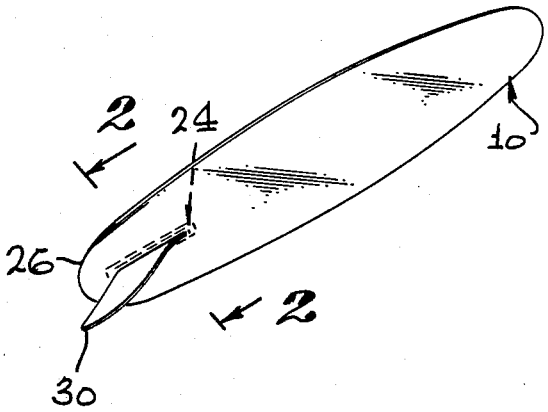
FIG. 1
FIG. 2
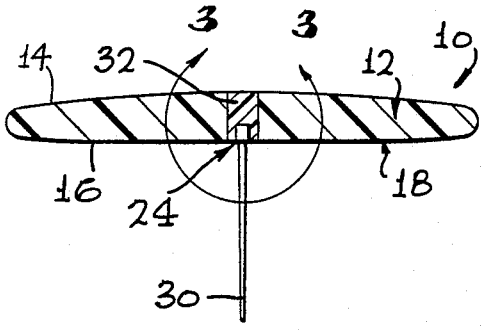
FIG. 3
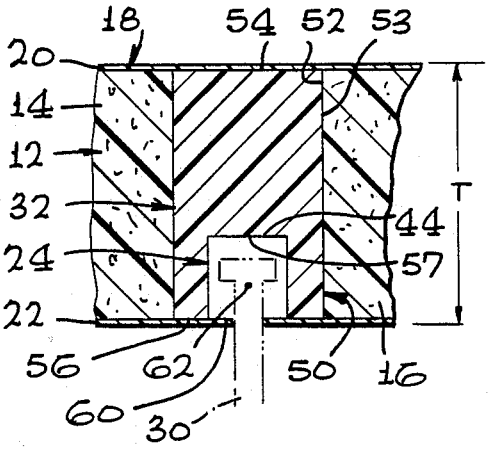
FIG. 4
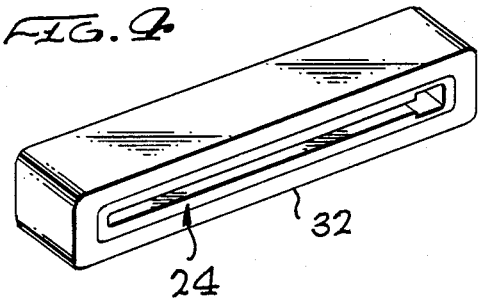
FIG. 5
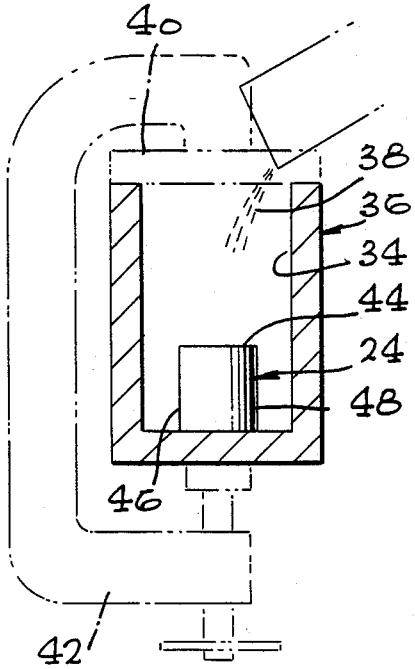
FIG. 6
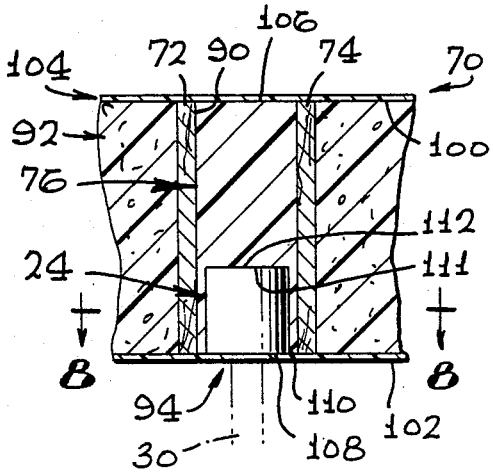

FIG. 7
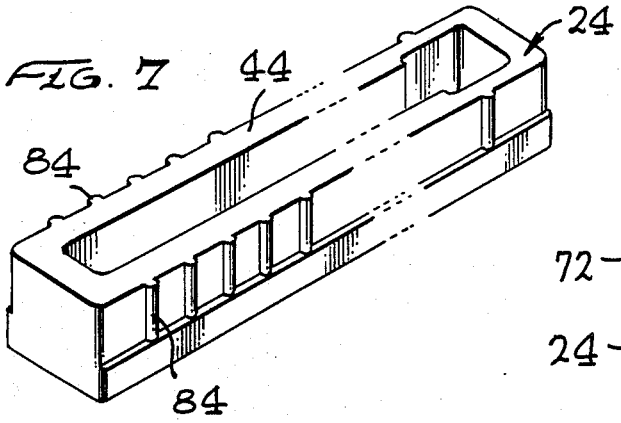
FIG. 8
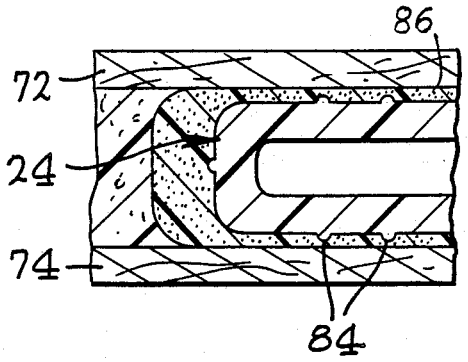
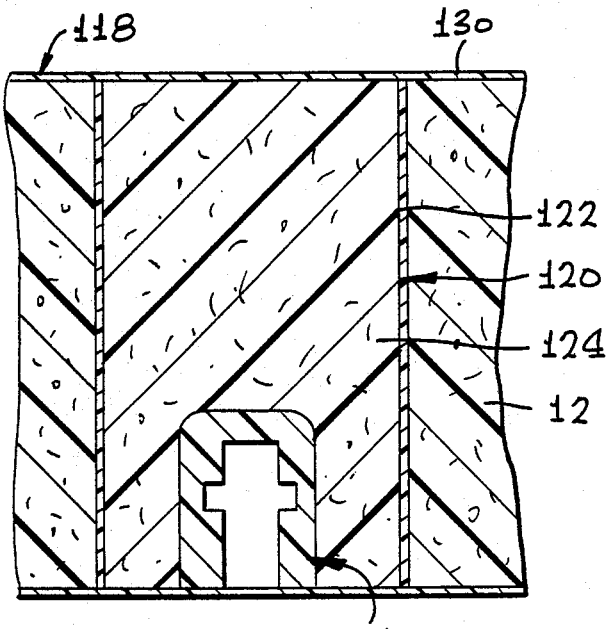
FIG. 10
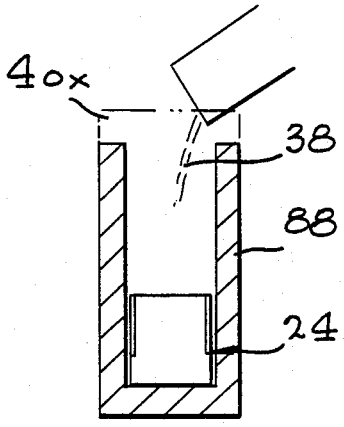
FIG. 9
FIG. 11
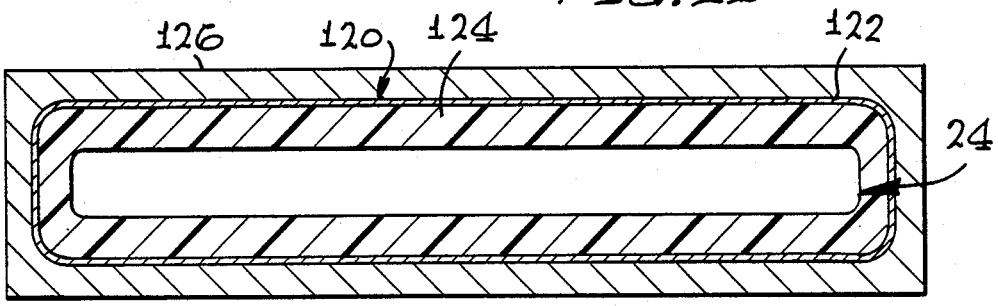

SURFBOARD FIN RETAINER

BACKGROUND OF THE INVENTION

Surfboards, windsurfers, and small sailboats are water riding boards, or crafts, which generally include a foam core (unfinished board) in which a fin box is installed which holds a downwardly-projecting fin that provides directionality to the craft or board in water. A shallow groove is routed in the bottom surface of the board near its rear end, and the fin box is installed in the shallow groove, with the lower surface of the fin box even with the lower surface of the foam core. The sides and upper surface of the fin box may be bonded, as with adhesive, to the walls of the groove. The board is finished by "glassing" it, which involves applying a strong but thin surface layer to the entire surface of the foam core, such as a resin-impregnated fibrous layer. The resin also bonds to the bottom surface of the fin box.

It is very common for the fin boxes to break out of the board. For example, when the rear of a rapidly moving surfboard rises out of the water and is turned sidewardly before it again hits the water, the large sideward force applied to the fin may break the fin box out of the board. The large torque applied to the fin box is resisted by the "glass" surface layer and by the foam in the board, but the resistance is not sufficient to avoid frequent breakout of the fin box. A technique for securing the fin box against breakout, by the more effective transfer of torque applied to the fin box to the rest of the board, and which was of relatively low weight and low cost, would be of considerable value.

SUMMARY OF THE INVENTION

In accordance with one embodiment of the present invention, a retainer is provided for securely holding a fin box to a water riding board, wherein the retainer is lightweight and of relatively low cost. The retainer is formed primarily of a rigid plastic foam, preferably of a density greater than that of the foam in the core of the board, and is molded against the fin box to closely conform and bond thereto. A groove is formed in the rear of the foam core of the board for holding the retainer and fin box, the groove extending through the entire thickness of the core. The retainer and fin box are installed in the groove. When a surface layer is applied, the upper face of the retainer is bonded to the upper portion of the surface layer and to the bottom of the fin box and/or the bottom of the retainer is bonded to the lower portion of the surface layer. The retainer can include a sleeve lying around and bonded to the sides of the foam part of the retainer.

The novel features of the invention are set forth with particularity in the appended claims. The invention will be best understood from the following description when read in conjunction with the accompanying drawings.

BRIEF DESCRIPTION OF THE DRAWINGS

FIG. 1 is a bottom perspective view of a surfboard constructed in accordance with the present invention.

FIG. 2 is a sectional view taken on the line 2—2 of FIG. 1.

FIG. 3 is a sectional view of the area 3—3 of the board of FIG. 2.

FIG. 4 is a bottom perspective view of the retainer/-fin box assembly of the board of FIG. 1.

FIG. 5 is a sectional view of a mold, showing a method for forming the retainer/fin box assembly of FIG. 4.

FIG. 6 is a sectional view of a portion of a board constructed in accordance with another embodiment of the invention.

FIG. 7 is a bottom perspective view of the fin box of FIG. 6.

FIG. 8 is a partial sectional view taken on the line 8—8 of FIG. 6.

FIG. 9 is a side sectional view of a mold, showing how the retainer/fin box assembly of FIG. 6 can be formed.

FIG. 10 is a sectional view of a portion of a board constructed in accordance with another embodiment of the invention.

FIG. 11 is a top sectional view of a mold, showing how the retainer/fin box assembly of FIG. 10 can be formed.

DESCRIPTION OF THE PREFERRED EMBODIMENTS

FIGS. 1–2 illustrate a surfboard 10 which includes a rigid plastic foam core 12 that has upper and lower sides 14, 16, and a thin but strong surface layer 18 lying around the core. As shown in FIG. 3, the surface layer 18 has upper and lower portions 20, 22 which lie against the upper and lower sides of the foam core and are bonded thereto. A fin box 24 lies in the lower side 16 of the core near the rear end 26 of the board, and is used to hold a fin 30 that helps to move the board in a forward direction in the water. The fin 30 may project about one foot below the bottom of the board that may have a width of about 2 feet, so that a moderate sideward force applied to the fin produces considerable torque tending to break the fin box 24 out of the board. Such large forces may be applied when the rear of a rapidly moving board rises out of the water while the board is turning, and the fin then strikes largely sideways against the water. The fin box is a commonly available item molded of a tough plastic such as an ABS type, has a length of about one foot, has a width of about an inch, and a height of one and one-quarter inch. In the prior art the fin box was installed in a one and one-quarter inch deep groove routed in the bottom of the foam core of the board. The large torque applied to the fin box when the fin was hit sidewardly, resulted in forces being applied to the foam core of the board as well as the bottom surface layer, which could not withstand the forces and which resulted in the fin box frequently breaking loose. The breaking loose of the fin box of prior art boards is a very common occurrence, and prevents further use of the board until it is repaired at substantial expense.

In accordance with the present invention, a retainer 32 is provided which holds the fin box 24 in the foam core 12 of the board, and which transmits torque resulting from sideward forces on the fin 30, without the fin box breaking loose from the retainer 32 or the retainer breaking loose from the rest of the board. The retainer is formed, as indicated in FIG. 5, by placing the fin box 24 in the cavity 34 of a mold 36. Then liquid foamable material 38 is poured into the mold and the mold is closed as by a cover 40. The mold is clamped shut as by a clamp indicated at 42. The fin box 24 is formed of a tough plastic such as an ABS type while the foamable material is of a type which has a low surface energy so that it adheres tightly to most other surfaces, applicant preferring a polyurethane foam. As the foamable material expands in the mold, it presses tightly against the upper surface 44 and opposite side surfaces 46, 48 of the fin box and adheres tightly to the surfaces.

Applicant provides sufficient liquid foamable material so that the foam of the retainer has a high density such as about 6 to 8 pounds per cubic foot. This can be contrasted with the foam in the core 12 of the board, which typically has a density of 2 to 3 pounds per cubic foot. Although the foam of the retainer is only about twice as dense as that of the core, the foam of the retainer is much more than twice as rigid and twice as strong. After the molding operation, applicant cuts away the side surfaces of the retainer 32, as with a band saw. This removes the wax coating on the retainer, which is necessary to prevent it from sticking to the mold.

The assembly 50 (FIG. 3) of the fin box 24 and the dense foam retainer 32 intimately bonded thereto, is installed in the foam core 12 of the board by forming (as by routing) a slot or groove 52 in the foam core. The groove extends through the entire height of the core between its upper and lower sides 14, 16. The retainer/-fin box assembly 50 is then installed in the groove; its sides 52 may be bonded by an adhesive 53 to the walls of the groove. The surface layer 18 is applied over the core and the retainer/fin box assembly.

The surface layer 18 is formed of a thin but tough material such as fiberglass impregnated with resin. When the layer is applied to the board, with the resin in a viscous state, the resin bonds tightly to the surface of the foam core 12, especially as the resin can enter the open cells at the surface of the foam core to provide a very tight bonding therewith. With the retainer/fin box assembly 50 in place, the resin of the upper surface layer portion 20 bonds tightly to the upper surface 54 of the retainer, while the resin of the lower surface layer portion 22 bonds tightly to the bottom surface 56 of the retainer. Also, the resin in the lower portion 22 of the surface layer bonds to the bottom surface 60 of the fin box.

When the fin 30 is pushed hard to the side and tends to twist the fin box about a longitudinal axis 62, this is resisted largely by the retainer 32. As mentioned above, the high density of the foam in the retainer results in its having high rigidity and strength to withstand considerable forces tending to twist the fin box, especially because of the intimate bonding contact of the retainer to the upper and side surface of the fin box 24. The retainer 32 resists twisting in the core 12 largely by bonding contact of the upper and lower surfaces 54, 57 of the retainer with the upper and lower surface layer portions 20, 22. Although the surface layer 18 is thin, it has considerable strength in tension along its surface, and efficiently transmits forces to the surface of the foam core 12 of the board. The fact that the retainer/fin box assembly is bonded to both the upper and lower surface layer portions 20, 22, which are three to four inches apart in a typical board, results in considerable ability of the assembly to resist torque applied by a blow to the fin 30. The retainer 32 also presses against a wide area of the foam core 12 when subjected to torque, to further resist breaking loose of the assembly from the foam core.

With the retainer 32 of about twice the density of the foam core 12, the retainer has about twice the weight as the amount of foam of the core which it replaces. However, the retainer 32 is still of relatively light weight, does not add considerably to the weight of the board, and does not result in a high cost for the foamable liquid. The board of FIG. 3 has a thickness T of about 4 inches, with the upper and lower surface layer portions 20, 22 each having a thickness of about one hundredth as great, but providing considerable strength in transferring loads to the foam core as described above. The fin box 24 has a width and height that are each about one inch and a length of about twelve inches. The retainer 32 has a width of about 2 inches. The retainer has a volume of about 84 cubic inches and a weight of about 5 ounces, which adds only a small amount (an additional 2.5 ounces) to the weight of the board. Despite this, the retainer distributes forces over a considerable area of the board and of the surface layer thereon. By molding liquid foamable material against the fin box, applicant provides intimate conformity of their adjacent surfaces and bonding of the surfaces to each other, in a low cost method that avoids having to bond already-hardened foam to the fin box. By placing the resulting assembly in a groove that extends through the entire thickness of the core, the assembly is bonded to the upper and lower surface layer portions of the board, and applicant provides high strength against breakout of the fin box.

FIG. 6 illustrates another board 70 of the custom type, which includes a pair of ¼-inch wide wood stringers 72, 74 that are each of a length of about a foot and that are molded into the foam core 92 and separated by slightly more than the width of the fin box 24. Applicant uses a retainer 76 of a width about the same as the separation between the stringers to securely hold the fin box 24. As shown in FIG. 9, the fin box 24 is placed in a mold 88 about as wide as the fin box, the liquid foamable material 38 is poured into the mold, and the mold is closed as by a cover 40X and a clamp. As shown in FIG. 7, the commonly available fin box 24 has vertical projections 84 spaced along its length at its opposite sides to fit tightly in a shallow groove. Applicant molds the foamable material, as shown in FIG. 8, so it has has portions 86 that lie between the vertical projections 84 on the fin box. The foam retainer 76 is of high density foam as is described for the retainer of FIG. 3.

To install the retainer 76, a groove 90 (FIG. 6) is formed in the foam core 92, the groove being of about the same width as the space between the stringers 72, 74. The assembly 94 of retainer and fin box is installed in the groove. An adhesive may be applied to the sides of the retainer to hold it to the walls of the groove in the core, although this is not always necessary. When the upper and lower surface portions 100, 102 of the surface layer 104 is applied over the opposite faces of the board, the surface layer adheres to the upper surface 106 of the retainer and to the lower surface 108 of the fin box. The surface layer also adheres to a small surface area at the bottom surface 110 of the retainer, although there is only a small surface thereat. The intimate bonding of the lower surface 111 of the retainer and the upper surface 112 of the fin box holds them tightly together. In this arrangement also, the assembly 94 of retainer and fin box is held to the upper and lower surface layer portions and extend along the entire thickness of the core, which distributes forces resulting from torque on the fin 30 to a wide area of the foam core to resist breakout of the fin box.

FIG. 10 illustrates a board 118 with another retainer 120 which is similar to the retainer of FIG. 3, except that the retainer includes a sleeve 122 such as of solid vinyl, around the foam portion 124 of the retainer. The sleeve, which is an extruded thin-wall plastic part, closely fits in the mold 126 (FIG. 11) during molding of the retainer around the fin box 24. The polyurethane foam portion of the retainer conforms to and bonds to the inside of the sleeve 122, so the surface of the dense foam portion 124 does not have to be trimmed (as by a band saw) to provide a clean and dense outer surface. The density of the foam portion 124 of the retainer does not have to be higher than that of the core 12, although applicant prefers a somewhat higher density. It may be noted that the retainer/fin box assembly 120 (and those in FIGS. 3 and 6) is initially molded slightly thicker than the core of the board. The upper and lower surfaces of the installed assembly 120 are sanded to make them even with the surfaces of the core before the surface layer 130 is applied.

Thus, the invention provides a surfboard, windsurfer, or other water craft with a retainer for holding the fin box securely to the rest of the board, which is of relatively low cost and lightweight. The retainer is a foam molded intimately against the fin box. Where there is no sleeve about the foam portion of the retainer, the retainer is primarily of foam of a density more than 50% of the core of the board, and preferably at least about 100% greater. The assembly of retainer and fin box has a height about the same as that of the foam core and lies in a groove routed or otherwise formed in the foam core which extends through the entire thickness of the foam core between its upper and lower faces. The upper and lower faces of the retainer and fin box assembly contacts the upper and lower surface portions of the surface layer of the board, so that some of the forces resulting from a sideward blow to the fin, are transmitted to the surface layers of the board (as well as over a wider area of the foam core). The retainer can be made with a height less than the thickness of the core of the board and lie in a groove of comparable height, which is a majority of the core thickness and more than that of the fin box, to transfer torque more effectively than in the prior art though not as well as for the illustrated retainers.

Although particular embodiments of the invention have been described and illustrated herein, it is recognized that modifications and variations may readily occur to those skilled in the art and consequently it is intended to cover such modifications and equivalents.

What is claimed is:

1. In a water board which includes a rigid foam core of moderate weight per unit volume, having upper and lower sides, a stronger surface layer lying around and bonded to the core and having upper and lower surface layer portions lying respectively against said upper and lower sides of said foam core, and a fin box with upper and lower surfaces lying in the core for holding the upper end of a fin that projects downwardly from the fin box, the improvement comprising:

a retainer of rigid plastic foam lying in said foam core, said retainer having an upper surface lying substantially even with the upper side of said foam core and bonded to said upper surface layer portion, said retainer having a lower surface bonded to the upper surface of said fin box, and said fin box having a lower surface bonded to said lower surface layer portion, whereby to hold the assembly of the retainer and fin box to both the upper and lower surface layer portions to resist breakout of the fin box when the fin is pushed sidewardly.

2. The improvement described in claim 1 wherein:

said fin box has opposite sides;

said foam retainer has a lower portion which surrounds said opposite sides of said fin box and which forms said lower surface which is bonded to said upper surface of said fin box, said lower portion of said retainer also including a bottom surface that is substantially even with the lower side of said foam core and the lower surface of the fin box, said bottom surface of said retainer being bonded to said lower surface layer portion.

3. The improvement described in claim 1 wherein:

said retainer is molded to said fin box, with bonding between them solely by adhesion of said rigid plastic foam of said retainer to the surface of said fin box.

4. The improvement described in claim 1 wherein:

said retainer is formed of plastic foam of a weight per unit volume more than 50% greater than that of said foam core.

5. The improvement described in claim 1 wherein:

said rigid plastic foam of said core is of polyurethane and has a density no more than about 3 pounds per cubic foot, and said rigid plastic foam of said retainer is of polyurethane and has a density of at least 6 pounds per cubic foot.

6. The improvement described in claim 1 wherein:

said retainer includes a foam part having a side and upper and lower surfaces, and a sleeve of substantially solid material surrounding said side of said foam part, said foam part being molded intimately against and bonded to said sleeve.

7. A water riding board comprising:

a board core of rigid plastic foam having front and rear end portions and upper and lower surfaces, said core having a groove in its rear end portion, said groove extending through the entire thickness of said core between its upper and lower surfaces;

a retainer and fin box assembly which includes a fin box and a retainer bonded thereto;

said fin box having upper and lower surfaces and opposite sides and a groove in its lower surface for holding a fin;

said retainer comprising a part of rigid plastic foam having a lower surface bonded to said fin box upper surface, a lower portion bonded to said opposite sides of said fin box, and a bottom surface lying at least as low as the lower surface of said fin box, said retainer with said fin box bonded thereto being disposed in said groove in said board with the upper and bottom surfaces of said foam part lying substantially even with said board core upper and lower surfaces respectively;

a surface layer with upper and lower portions lying over said board core upper and lower surfaces, said upper and bottom surfaces of said foam part lying against and bonded respectively to said upper and lower portions of said surface layer.

8. The board described in claim 7 wherein:

said retainer foam part is foamed and molded around said fin box and is held to said fin box solely by bonding of said retainer foam to the surface of said fin box by adhesion of said retainer foam to said fin box.

9. The board described in claim 7 wherein:

said retainer also includes a sleeve surrounding said foam part, said foam part molded against and bonded to said sleeve.

10. The board described in claim 7 wherein:

said retainer part of plastic foam has a density greater than that of the foam of said core.

11. A method for holding a fin box with upper and lower surfaces, in a foam core of a water riding board, the core having forward and rearward portions and upper and lower surfaces, comprising:

forming a through groove in said core rearward portion, so the groove extends through the entire thickness of the core between its upper and lower surfaces;

placing the fin box in a mold having a height at least equal to said thickness of said core at said groove therein, placing a foamable liquid in said mold, closing said mold, and allowing said liquid to foam and expand to fill the mold under pressure and bond to said fin box, to form an assembly which includes a foam retainer bonded to the fin box;

placing said assembly of said retainer and fin box in said groove, with the fin box lowermost, so the assembly has upper and lower portions;

applying a surface layer to the upper and lower surfaces of the core including allowing said surface layer to bond to the core and to the upper and lower portions of the assembly.

12. The method described in claim 11 wherein:

said step of placing a foamable liquid includes placing sufficient foamable liquid in said mold to produce a foam of greater density than the foam of said core.

13. The method described in claim 11 wherein:

said step of placing the fin box in a mold includes placing the fin box in the first end of a mold whose first end has a width greater than the width of the fin box, and said step of allowing said liquid to foam and expand includes allowing said liquid to foam to form a retainer which lies against and bonds to the sides and top of the fin box, and which has a lower surface approximately level with the lower surface of the fin box;

said step of applying a surface layer includes allowing said layer to bond to the uppermost and lowermost surfaces of said foam retainer;

14. The method described in claim 11 including:

placing a sleeve against the side walls of said mold, said step of placing the fin box includes placing it substantially within said sleeve, and said step of placing a foamable liquid and allowing it to foam includes allowing it to foam within and bond to the inside of said sleeve.

* * * * *